United States Patent [19]

Morane

[11] Patent Number: 4,775,081

[45] Date of Patent: Oct. 4, 1988

[54] DEVICE FOR THE ACTUATOR OF A VALVE FITTED ON A PRESSURIZED CONTAINER

[75] Inventor: Bruno Morane, Neuilly, France

[73] Assignee: L'Oreal, Paris, France

[21] Appl. No.: 10,844

[22] Filed: Feb. 4, 1987

[30] Foreign Application Priority Data

Feb. 21, 1986 [FR] France ..... 86 02404

[51] Int. Cl.[4] ..... B65D 83/00

[52] U.S. Cl. ..... 222/402.13; 222/402.19

[58] Field of Search ..... 239/337, 587–588; 285/330, 913; 222/182, 402.1, 402.13, 402.19, 402.21, 402.22, 402.24, 526, 533, 536, 566–567

[56] References Cited

U.S. PATENT DOCUMENTS

| | | | |
|---|---|---|---|
| 556,106 | 3/1896 | Schiele | 285/330 X |
| 1,031,587 | 7/1912 | Reisik | 285/330 |
| 3,116,856 | 1/1964 | Prussin et al. | 222/402.24 |
| 3,140,014 | 7/1964 | Lerner | 222/402.13 |
| 3,148,806 | 9/1964 | Meshberg | 222/402.11 |
| 3,542,254 | 11/1970 | Samuelson et al. | 222/402.19 |
| 3,567,081 | 3/1971 | Meshberg | 222/402.17 |
| 3,610,480 | 10/1971 | Lipfert et al. | 222/402.21 |
| 3,910,502 | 10/1975 | Mermillod | 239/531 |
| 4,533,273 | 8/1985 | Obata et al. | 401/190 |

FOREIGN PATENT DOCUMENTS

| | | | |
|---|---|---|---|
| 2129940 | 3/1972 | France . | |
| 3420765 | 12/1985 | Fed. Rep. of Germany | 239/587 |

*Primary Examiner*—Michael S. Huppert

*Attorney, Agent, or Firm*—Cushman, Darby & Cushman

[57] ABSTRACT

A container is provided with a dispensing device including a bent delivery tube directable in relation to a valve-actuating element which is displaceable in relation to a mounting skirt for fixing the device on the container; dispensing of the product from the containers by way of a duct having a first portion arranged in the delivery tube and a second portion in the actuating element which includes an oblique surface in relation to the axis of the skirt; a delivery tube includes a swiveling mount for moving it about an axis normal to the oblique surface and an abutment means for bearing on the oblique surface so that in one position the delivery tube is substantially parallel to the axis of the skirt.

11 Claims, 2 Drawing Sheets

DEVICE FOR THE ACTUATOR OF A VALVE FITTED ON A PRESSURIZED CONTAINER

FIELD OF THE INVENTION

The present invention relates to a device for actuating a valve fitted on a pressurised container of the "aerosol can" type, comprising in particular a directable bent delivery tube, as well as an actuating element substantially normal to the axis of the container.

In particular the present invention relates to a device for actuating a valve, fitted on a pressurised container, which comprises a movable delivery tube allowing operation both on a container comprising a dip tube within the container and on a container without such a dip tube.

PRIOR ART

The pressurised containers of the above type comprise a valve actuated by a device provided with an actuating element, generally a push button, which the user presses in order to eject the product from this container. This valve may, or may not, be joined to a dip tube situated within the container.

Such a device generally comprises a skirt fixed to the wall of the container, a dispenser tube joined to the outlet tube of the valve and a push button allowing operation of the valve to feed the delivery tube.

U.S. Pat. No. 3116856 discloses a device for actuating a valve of a pressurised container, comprising a directable swivelling dispenser tube. This device comprises a push button provided with a skirt which can slide along the valve cup of the container. This push button comprises a duct which communicates the valve outlet tube with the duct of a swivelling delivery tube whose rounded end is accommodated in a spherical housing in the push button. This dispenser tube can occupy a first position in which it is substantially normal to the axis of the container and a second position in which it is substantially parallel to the container axis and is situated along this container. The first position corresponds to an open position and the second position to a closed position. According to said U.S. Pat. No. 3116856 it appears necessary for this delivery tube to be in the first position for discharge of the product from the container and therefore the dispensing is not effected in the two positions of the delivery tube so that the position of the delivery tube cannot allow the device to be adjusted to the presence or absence of a dip tube.

U.S. Pat. No. 3148806 discloses a push button on which is fitted a bent delivery tube which is normal to the push button and is force-fitted in a recess of this push button and can swivel relative to the push button. The communication between the container interior and the delivery tube takes place in any position of the delivery tube with the exception of the low position, that is to say, when the free end of the delivery tube is directed towards the bottom of the container, in which case the push button can no longer be displaced in translation because of the interposition of a cross piece block integral with the delivery tube abutting this container. It will be observed that in this embodiment, the dispenser tube does not enable dispensing in all the positions provided for the delivery tube, and that the various positions provided for the delivery tube therefore do not allow the device to be used both with and without a dip tube.

U.S. Pat. No. 3567081 relates to a multidirectional aerosol dispenser. This device comprises a relatively short delivery tube which is bent and fitted so as to be capable of turning in the cylindrical base of a push button. This delivery tube comprises a first portion arranged as an extension of the valve outlet tube and substantially normal to the container axis, and a second very short portion forming an obtuse angle with the first portion. This delivery tube comprises means which, in cooperation with other means carried by the push button, make it possible to prevent the delivery tube from being torn off. Such a device allows delivery of the product along all the generatrices of a cone, but this dispensing is never effected along the axis of the container, nor perpendicular to this axis. If it is desired to use the valve with a container without a dip tube, it is necessary for the container to be capable of use in an upside down position whch implies dispensing substantially parallel to the container axis; this possibility does not exist in the use of the device described in this prior document.

OBJECT OF THE INVENTION

It is an object of the invention to provide a valve-actuating device which can be fitted both to a container with a dip tube and to one without a dip tube.

SUMMARY OF THE INVENTION

The object described above is attained by means of a device for actuating a valve fitted on a pressurised container of the "aerosol can" type, this device comprising an actuating device which is displaceable in relation to a skirt capable of being fixed on the container, thereby allowing the valve of this container to be actuated; and a bent delivery tube directable by swivelling in relation to said actuating device, ejection of the product contained in the container being effected via a duct having a first portion in the delivery tube and a second portion in the actuating element; the device is according to the present invention characterised in that the actuating element comprises a surface which is oblique in relation to the axis of the skirt, the delivery tube comprising means for swivelling around an axis normal to this oblique surface and means for bearing on this oblique surface, one of the possible positions of the delivery tube being substantially parallel to the axis of said skirt.

Preferably this oblique surface forms an angle of approximately 45° with the skirt axis; the means on the delivery tube for bearing on this oblique surface are constituted by a surface substantially parallel to the oblique surface itself.

In a first embodiment, the bearing means comprise a projection surrounding the second duct portion and substantially normal to the oblique surface.

In a second embodiment, the second duct portion arranged in the actuating means comprises a short extension projecting from the oblique surface and having the delivery tube fitted thereto.

Preferably the delivery tube can occupy two positions: in the first it is substantially parallel to the skirt axis, and in the second it is substantially perpendicular to this axis.

Advantageously, this extension comprises at least one longitudinal projection cooperating with at least one longitudinal groove in the first duct portion which is arranged in the delivery tube on this extension. This extension comprises a single projection, whereas the first duct portion comprises two longitudinal grooves which are symmetrical in relation to the axis of this duct. This extension can also comprise two projections.

The present invention also provides a pressurised container of the "aerosol can" type comprising a dip tube, having the above-mentioned device fitted thereon, the delivery tube being substantially normal to the skirt axis, that is to say to the axis of the container, in such a way that the ejection of the product contained in this container is substantially normal to the axis of this container.

The invention also provides a pressurised container of the "aerosol can" type which does not comprise a dip tube, but is fitted with the device described above, the delivery tube thereof being substantially parallel to the skirt axis, that is to say to the axis of the container, in such a way that ejection of the product is effected substantially parallel to the axis of the container, with the container held upside down.

BRIEF DESCRIPTION OF THE DRAWINGS

The description that follows is not intended to be of a restrictive nature and should be read in conjunction with the accompanying drawings, in which.

DESCRIPTION OF THE PREFERRED EMBODIMENTS

Figure 1:
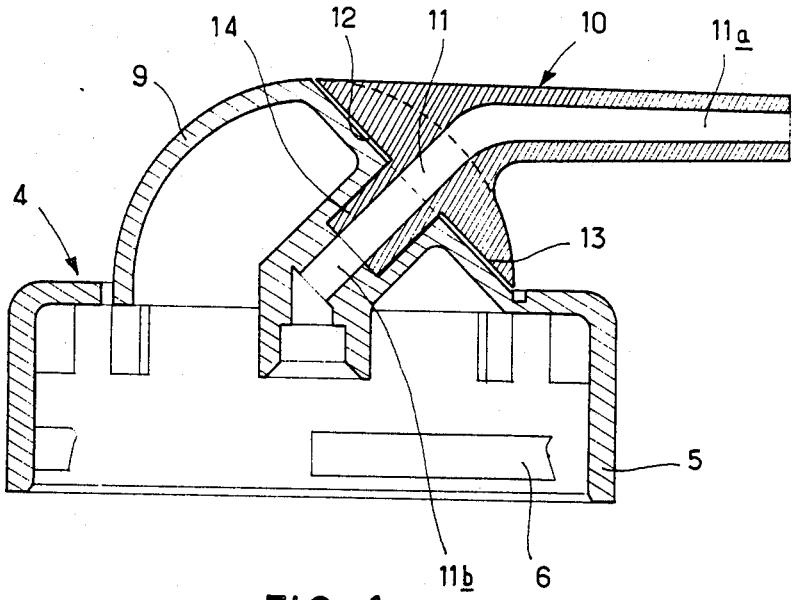
FIG. 1 is an axial cross-section of a first embodiment of a device in accordance with the present invention for actuating a valve of a pressurised container of the "aerosol can" type.
Figure 2:
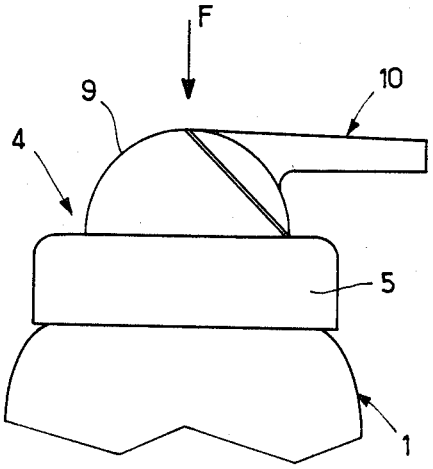
FIG. 2 is an elevation of the device of FIG. 1, when the delivery tube of this device is substantially normal to the axis of the container.

As may be seen in these Figures, a pressurised container of the "aerosol can" type, designated by the reference numeral 1 as a whole, comprises a valve 2 (cf. FIG. 4) in what is the upper portion when this container rests on its bottom 3. By depressing and holding down this valve 2, a larger or smaller quantity of the product contained in this container may be dispensed.

For actuating this valve 2 there is a device, designated by the reference numeral 4 as a whole, which comprises a skirt 5 having on its internal wall projections 6 to fix this device on the container 1 by cooperating with the crimped bead 7 of the valve cup 8. It also comprises an actuating element 9 which is fixed to the skirt 5 over at least a portion thereof and which is displaceable in relation to this skirt. This actuating element comprises, in a manner known per se, means which cooperate with the valve 2 to allow some of the product contained in the container 1 to be ejected when a user exerts on this actuating element 9 a force substantially normal to the axis of the container, that is to say to the axis of the skirt 5. The direction of such a force is represented by arrow F in FIGS. 2 to 5.

The device 4 comprises a bent delivery tube 10 which is directable by swivelling in relation to the actuating element 9. Ejection of the product contained in the container 1 is by way of a duct 11 having a first portion **11*a* in the delivery tube 10, and a second portion 11*b* in the actuating element 9**.

In accordance with the present invention, the actuating element 9 comprises a surface 12 oblique in relation to the axis of the skirt 5, the delivery tube 10 comprising means for swivelling around an axis normal to this surface and means for abutting this oblique surface 12. These abutment means are constituted by a surface 13 substantially parallel to the oblique surface 12. In accordance with the invention, one of the possible positions of the delivery tube 10 is substantially parallel to the axis of the skirt 5.

The angle between the oblique surface 12 and the axis of skirt 5, which corresponds to the axis of the container 1 on which the device 4 is fitted, is preferably equal to approximately 45°. This allows the delivery tube 10 to adopt two positions: in a first position, the product contained in the container 1 will be ejected substantially normal to the axis of this container; in a second position, this ejection can be substantially parallel to the container axis.

In a first embodiment the bearing surface 13 of the delivery tube 10 comprises a projection 14 which surrounds the second portion **11*b* of the duct 11 and is substantially normal to the oblique surface 12; the delivery tube 10 can thus turn around this portion 11*b*** so as to adopt the position desired by the user.

Figure 3:
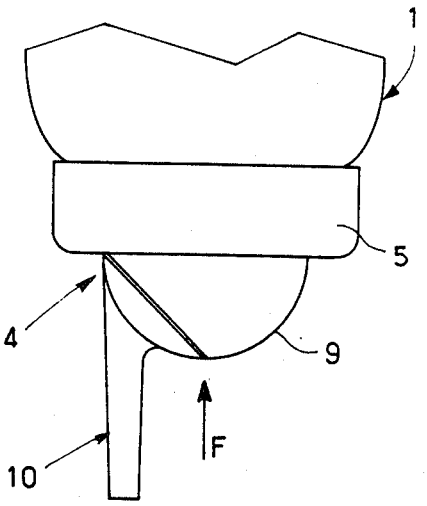
FIG. 3 is an elevation of this same device when the delivery tube is parallel to the axis of the container, the latter being up-ended in relation to the preceding Figure.
Figure 4:
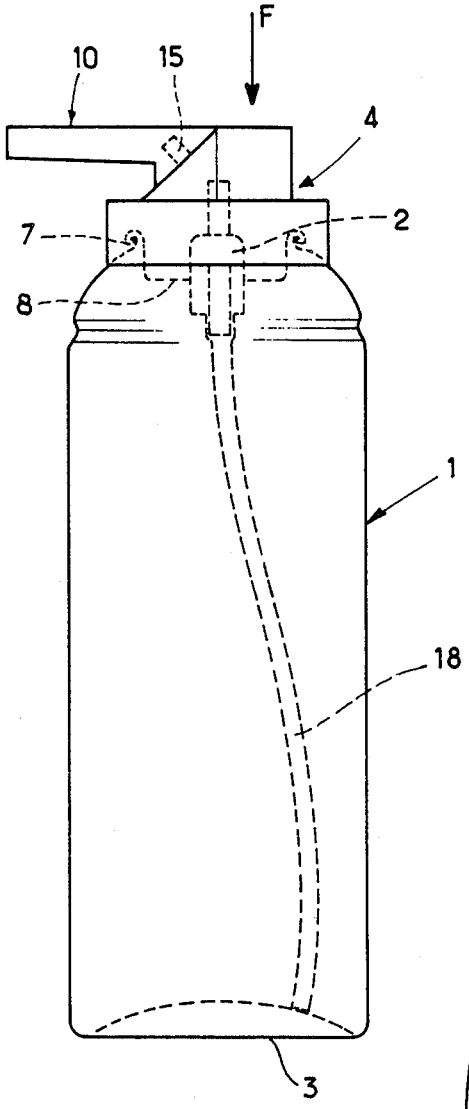
FIG. 4 is a schematic external view of a container comprising a dip tube and provided with a device in accordance with the present invention.
Figure 5:
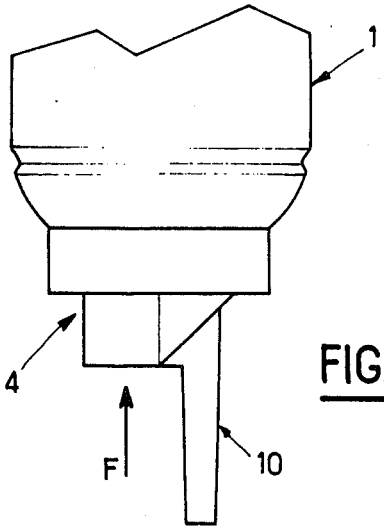
FIG. 5 is a schematic elevation of part of a container without a dip tube and provided with a device in accordance with the present invention in the configuration of use, that is to say upside down.
Figure 6:
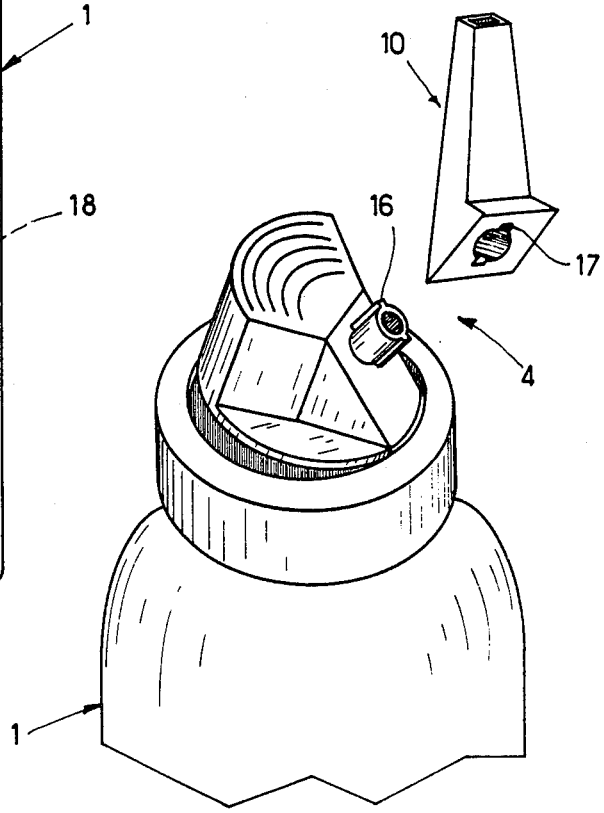
FIG. 6 is an exploded perspective of the upper portion of a pressurised container provided with a device in accordance with the present invention showing one mode of fitting the delivery tube on this container.

A second embodiment of the present invention is represented in FIGS. 4 and 6 wherein the elements similar to those of FIGS. 1 and 3 have the same reference numerals.

The second portion **11*b* of the duct 11 comprises a short extension 15 which thus projects from the oblique surface 12 and on which the delivery tube 10** is fitted. The delivery tube can therefore turn around this extension and be orientated along the direction desired by the user.

If the bent delivery tube 10 is to be preorientated in relation to the axis of the skirt 5 of the device 4, this extension 15 can be provided with at least one longitudinal projection 16 (FIG. 6), whilst the delivery tube 10 will comprise at least one longitudinal groove 17 arranged in the first duct portion **11*a*. The first duct portion 11*a* can comprise two such grooves 17 symmetrically disposed in relation to the axis of this duct; the delivery tube 10 can thus be disposed on the oblique surface 12 along two directions, the first allowing ejection of the product from the container 1 in a direction substantially perpendicular to the axis of the container, the other allowing this ejection to be substantially parallel to the container axis. The device in accordance with the present invention is particularly advantageous, because it allows the same unit to be used on any pressurised container 1 of the "aerosol can" type regardless of whether or not it comprises a dip tube 18**.

Quite obviously, it is possible to fit at the end of the delivery tube 10 any equipment for diffusing the contents of the container 1, such as a screen in order to enhance foaming when the product is foam.

I claim:

1. In a device for actuating a valve of a pressurized container of the aerosol can type having an actuatable valve, the said device comprising:

a skirt capable of being fixed on the said container and supporting an actuating element for movement between an actuated and deactuated position relative to said skirt, said actuating element including a bent delivery tube, said actuating element being engageable with said valve whereby movement of said actuating element between said deactuated to said actuated position will effect actuation of said valve for dispensing of the contents of the container through said valve, said actuating element including duct means having a first portion connected to said delivery tube and a second portion engaging said actuatable valve, said bent delivery tube being connected to said duct means first portion, said bent delivery tube being movably connected on said actuating element, the improvement wherein said skirt has an axis and said actuating element comprises a surface which extends obliquely in relation to said axis of said skirt, said delivery tube comprising means mounting said delivery tube in a plurality of positions about an axis normal to said oblique surface and abutment means for bearing on said oblique surface, one of the possible positions of said delivery tube being substantially parallel to said axis of said skirt.

2. A device according to claim 1, wherein said oblique surface forms an angle of approximately 45° with said axis.

3. A device according to claim 1, wherein said abutment means are constituted by a surface which is substantially parallel to the said oblique surface.

4. A device according to claim 1, wherein the second duct portion is defined by a short extension which projects from said oblique surface and on which said delivery tube is fitted.

5. A device according to claim 4, wherein said extension comprises at least one longitudinal projection cooperating with at least one longitudinal groove in the first duct portion.

6. A device according to claim 5, wherein said extension comprises a single projection, and the first duct portion comprises two longitudinal grooves which are symmetrical in relation tothe axis of said duct.

7. A device according to claim 5, wherein said extension comprises two projections.

8. A device according to claim 1, wherein the delivery tube can occupy first and second positions, said first position being such that the delivery tube is substantially parallel to the axis of the skirt, and said second position being such that the delivery tube is substantially perpendicular to the axis of said skirt.

9. a pressurised container of the "aerosol can" type, comprising a dip tube and a device according to claim 1, the delivery tube of said device being substantially normal to the axis of the skirt such that ejection of the product from the container is substantially normal to the axis of said container.

10. A pressurised container of the "aerosol can" type which does not have a dip tube, comprising a device according to claim 1, the delivery tube of said device being substantially parallel to the axis of the skirt, such that the ejection of the product is effected substantially parallel to the axis of the said container when the container is held upside down.

11. The device as claimed in claim 1 wherein said oblique surface includes a projection defining said second portion of said duct means and extending substantially normal to said oblique surface.

* * * * *